US012110907B2

(12) United States Patent
Cavarec et al.

(10) Patent No.: US 12,110,907 B2
(45) Date of Patent: Oct. 8, 2024

(54) HEATING DEVICE AND VACUUM PUMP

(71) Applicant: PFEIFFER VACUUM, Annecy (FR)

(72) Inventors: Pierre-Emmanuel Cavarec, Annecy (FR); Romain Criado, Annecy (FR); François Roger, Annecy (FR); Eric Dulac, Annecy (FR)

(73) Assignee: PFEIFFER VACUUM, Annecy (FR)

( * ) Notice: Subject to any disclaimer, the term of this patent is extended or adjusted under 35 U.S.C. 154(b) by 0 days.

(21) Appl. No.: 18/253,800

(22) PCT Filed: Jan. 4, 2022

(86) PCT No.: PCT/EP2022/050068
§ 371 (c)(1),
(2) Date: May 22, 2023

(87) PCT Pub. No.: WO2022/148745
PCT Pub. Date: Jul. 14, 2022

(65) Prior Publication Data

US 2024/0018972 A1 Jan. 18, 2024

(30) Foreign Application Priority Data

Jan. 6, 2021 (FR) ..... 21 00090

(51) Int. Cl.
*F04D 29/58* (2006.01)
*F04D 19/04* (2006.01)
*F04D 29/02* (2006.01)

(52) U.S. Cl.
CPC ..... *F04D 29/584* (2013.01); *F04D 19/042* (2013.01); *F04D 29/023* (2013.01)

(58) Field of Classification Search
CPC .... F04D 19/042; F04D 19/044; F04D 29/023; F04D 29/584
See application file for complete search history.

(56) References Cited

U.S. PATENT DOCUMENTS 5,350,275 A * 9/1994 Ishimaru ..... F04D 29/023 415/217.1
9,638,200 B2 * 5/2017 Tsutsui ..... F04D 29/584
10,161,404 B2 * 12/2018 Tsutsui ..... F04D 29/023
2018/0335052 A1 11/2018 Sakaguchi

FOREIGN PATENT DOCUMENTS

DE 10 2013 207 059 A1 10/2014
EP 0 610 666 A1 8/1994

OTHER PUBLICATIONS

International Search Report & Written Opinion issued Mar. 23, 2022 in PCT/EP2022/050068, filed on Jan. 4, 2022, 11, pages.

* cited by examiner

*Primary Examiner* — Topaz L. Elliott
*Assistant Examiner* — Jason G Davis
(74) *Attorney, Agent, or Firm* — Oblon, McClelland, Maier & Neustadt, L.L.P.

(57) ABSTRACT

A heating device is for a vacuum line in which pumped gases are intended to circulate. The heating device includes at least one radiating body to radiate in the infrared when it is heated to a temperature above 150° C. The at least one radiating body is arranged in the pumping path of the gases.

19 Claims, 5 Drawing Sheets

1
6
F
F
F
I
8
2
11
18
15
3
17
10
4
19
9
10
14
F
F
25
23
13
5
24
24
7
103
33
27
20
21
22
18
I
12
16
22
23

2
22
21
25
20
24
23
24
7

1
6
I
F
F
F
8
2
11
18
15
3
17
10
4
19
9
10
14
F
F
25
13
5
22
20
22
21
21
7
33
26
27
26
23
18
12
16
23
I

HEATING DEVICE AND VACUUM PUMP

The present invention relates to a heating device and a primary or turbomolecular vacuum pump comprising said heating device.

The generation of a high vacuum in a chamber requires the use of turbomolecular vacuum pumps composed of a stator in which a rotor is driven in rapid rotation, for example rotation at more than ninety thousand revolutions per minute. These vacuum pumps are connected by pipes to so-called primary vacuum pumps which generally comprise two rotors for the dry pumping of the gases and which are configured to discharge the gases at or above atmospheric pressure.

In some methods in which the vacuum pumps are used, such as semiconductor or LED fabrication methods, a deposition layer can form in the vacuum pumps or in the inter-pump pipes, notably at the suction of the primary vacuum pumps. In the vacuum pumps, these deposits can result in a restriction of play between the stator and the rotor or rotors potentially provoking seizure of the rotor or rotors.

In the turbomolecular vacuum pumps, the deposition layer can heat up the rotor by friction, which can generate creep in the latter and then possible cracking. In the primary vacuum pumps, the deposition layers can reduce the operating plays between the rotors and between the rotors and the stator, which can lead to seizure of the vacuum pump.

It is known practice to heat up the stators and the pipes to avoid the condensation of reaction products in the pumps. Limiting the temperature below the temperatures admissible by the rotor or rotors makes it possible to reduce the formation of deposits in the pump but without totally preventing it.

In the turbomolecular pumps, a solution for better locating the heating inside the vacuum pump consists in printing heating elements on an insulating layer deposited on the stator, notably at the Holweck stage. These heating elements can be powered intermittently, for example one second at 500° C., which makes it possible not to overheat the rotor. These high temperatures of the heating elements make it possible to evaporate or break down the solid reaction products which are deposited on the heating elements or close to the heating elements, but without heating up the rotor. This surface heating, inside the vacuum pump, makes it possible to heat only the deposited material, and do so as it appears. However, this technology requiring the deposition of insulating layers on the stator and then the printing of heating resistors, and in particular on complex surfaces, can be difficult to implement, and therefore costly.

One aim of the present invention is to propose a heating device and a vacuum pump that at least partially resolve a failing of the state of the art.

To this end, the subject of the invention is a heating device for a vacuum line in which gases to be pumped are intended to circulate, the heating device comprising at least one radiating body configured to radiate in the infrared when it is heated to a temperature greater than 150° C., such as greater than or equal to 200° C., like 300° C. for example, the at least one radiating body being arranged in the pumping path of the gases.

The infrared radiation heating device can be arranged in a turbomolecular vacuum pump or in a pipe or in a primary vacuum pump.

In operation, the radiating body radiates in the infrared inside a vacuum pump or a pipe in the pumping path of the gases. The reflecting inner surfaces in the path of the pumped gases reflect the radiated heat in the absence of deposit while the deposits, generally made of organic material and of stronger emissivity, greater than 0.5, absorb the heat. The deposits therefore absorb more heat and their temperature rises more than the walls. The heat reflected by the walls also returns to the radiating body or the deposits. The deposits heated to high temperature can then be evaporated and driven in gaseous form to the discharge without overheating the walls. As the soon as the thickness of the deposit is sufficiently small to no longer absorb the infrareds, the latter are reflected. The elimination of the deposits can therefore be performed automatically, without driving or cycling the heating which can remain at high temperature. The heating is also targeted and therefore efficient.

The heating device can further comprise one or more of the features described hereinbelow, taken alone or in combination.

The radiating body has, for example, a surface of emissivity greater than or equal to 0.4.

The surface of emissivity of the at least one radiating body can be obtained:

- by surface treatment, such as by anodization or sandblasting or grooving or texturing, for example by laser, or treated with soda, or
- by deposition of a coating, such as a chemical coating deposited by plasma of KEPLA-COAT® type or such as a coating of solvent-free paint type, such as an epoxy polymer coating, or
- by heat treatment, in particular of surfaces made of steel or stainless steel.

The heating device can comprise at least one heating cartridge, the at least one radiating body being a thermal conductor in thermal contact with the at least one heating cartridge, the heating cartridge being arranged outside of the pumping path of the gases.

Cavities can be formed in the body of the heating device surrounding the heating cartridge.

The at least one radiating body can comprise a heating electrical resistor.

The radiating body comprises, for example, a bent rod, notably bent to follow the form of the pipe in which it is arranged and/or that of the interior of the vacuum pump.

In order to optimize the temperature rise of the radiating body before the thermal energy is diffused in the body of the vacuum pump or the pipe, it is preferable for the radiating body to have little thermal inertia, that is to say a small volume.

The heating device can comprise a processing unit configured to control the heating of the radiating body. The processing unit comprises, for example, a controller, a microcontroller or a microprocessor.

In use, the body radiating in the infrared can be heated continuously to a temperature greater than 150° C.

According to another exemplary embodiment, the processing unit is configured to heat up the radiating body to a temperature greater than 150° C. for it to radiate in the infrared by being powered by electric current pulses that make it possible to alternate periods of powering at a first power with periods of electrical powering at a second power lower than the first power or with periods of non-powering.

The duration of the pulses is, for example, greater than one minute and less than ten minutes. The temperature of the radiating body can thus be increased intermittently to a temperature greater than 300° C., such as between 400° C. and 600° C.

The powering by electrical current pulses, that is to say discontinuously, makes it possible to optimize the temperature rise of the radiating body before the thermal energy is diffused. The deposits can then be more easily heated to temperatures greater than the evaporation temperature of the deposits, notably deposits of PTFE type.

The processing unit can be configured to monitor the presence of deposits based on the temperature of the radiating body or on the measurement of the temperature of the surface of a pipe of the vacuum line and on the thermal power radiated by the radiating body, for example by measuring the temperature of the radiating body while the thermal power radiated by the radiating body is controlled to a given setpoint or by measuring the thermal power radiated by the radiating body while the temperature of the radiating body is controlled to a given setpoint.

In fact, the reaction by-products, notably deriving from certain semiconductor fabrication methods, are not only more emissive than the metals of the vacuum pump or of the pipe, but are also more thermally insulating. The thicker the layer of deposit becomes, the more it thermally insulates the stator body of the vacuum pump or the walls of the pipe from the infrared heating. When the radiating body is surrounded by surfaces of very low emissivity, it cannot transmit much energy. This phenomenon is therefore used here not only to evaporate the deposits, but also to determine their presence, even their thickness.

It is possible to monitor the deposits in the vacuum pump, but also in the pipe between the vacuum pumps, notably because the detection of a deposit in the pipe makes it possible to estimate a deposit in the vacuum pump.

Another subject of the invention is a vacuum line in which gases to be pumped are intended to circulate, the vacuum line comprising a pipe and a heating device as described previously, the at least one radiating body of the heating device being fixed to the pipe by being thermally insulated from the inner walls of the pipe.

Another subject of the invention is a vacuum pump configured to drive gases to be pumped in a direction of circulation of the gases going from a suction orifice to a discharge orifice, the vacuum pump comprising a stator and at least one rotor configured to rotate in the stator, characterized in that the vacuum pump further comprises a heating device as described previously, the at least one radiating body of the heating device being fixed to the body of the stator, by being thermally insulated from the inner walls of the stator.

In operation, the radiating body radiates in the infrared inside the vacuum pump in the pumping path of the gases. The inner surfaces of the vacuum pump in the path of the pumped gases are generally reflecting and reflect the radiated heat in the absence of deposit, whereas the deposits, generally of organic material and of stronger emissivity, greater than 0.5, absorb the heat. The deposits therefore absorb more heat and their temperature rises more than the walls of the vacuum pump. The heat reflected by the inner walls of the vacuum pump also returns to the radiating body or to the deposits. The deposits heated to high temperature can then be evaporated and driven in gaseous form to the outlet orifice without overheating the rotor or the inner walls of the stator. As soon as the thickness of the deposit is sufficiently small to no longer absorb the infrareds, the latter are reflected by the walls of the vacuum pump. The elimination of the deposits can therefore be performed automatically, without driving or cycling the heating which can remain at high temperature. The heating is further targeted and therefore efficient, without being detrimental to the integrity of the rotor.

The vacuum pump can further comprise one or more of the features described hereinbelow, taken alone or in combination.

The inner walls of the stator and the walls of the rotor intended to be in communication with the pumped gases exhibit, for example, an emissivity less than or equal to 0.2.

The inner walls of the stator and the walls of the at least one rotor intended to be in communication with the pumped gases are, for example, metallic, such as aluminium material or stainless steel or have a coating comprising nickel. The metal walls can be polished. These surfaces of low emissivity have the advantage of reflecting the infrared thermal radiations, which makes it possible, on the one hand, to avoid heating the inner walls of the stator and the walls of the rotor intended to be in communication with the pumped gases, and, on the other hand, to concentrate the heat on the deposits which generally are organic deposits exhibiting an emissivity greater than that of the surfaces of low emissivity. The fact that the walls of the stator and of the rotor in communication with the pumped gases of low emissivity, of aluminium material, stainless steel or steel or coated aluminium are made from materials of low emissivity is thereby used notably to allow them to withstand corrosion. These properties of low emissivity contribute to avoiding the heating of the vacuum pump while promoting the heating of the undesirable deposits.

The at least one radiating body can be situated at the discharge of the vacuum pump.

The vacuum pump can be a turbomolecular vacuum pump, the stator comprising at least one stage of fins and the rotor comprising at least two stages of blades, the stages of blades and the stages of fins following one another axially along an axis of rotation of the rotor.

The at least one radiating body is, for example, situated in the annular discharge of the vacuum pump, downstream of the rotor and upstream of the discharge orifice in the direction of the circulation of the gases.

The radiating body comprises, for example, a coil forming more than one turn around the rotor or forming more than one turn in the annular discharge of the vacuum pump, and at least one heating finger linking the coil to the stator body.

The radiating body comprises, for example, a ring or a portion of ring arranged at the periphery of the rotor or opposite the annular end of the rotor in an annular discharge of the vacuum pump and at least one heating finger linking the ring or the portion of ring to the stator body. The ring can have a spherical or ovoid section, or the ring can have a disc surface. The disc makes it possible to increase the radiating surface.

The at least one heating finger can form a spacer holding the ring or the portion of ring or the coil away from the stator body. The thermal contact between the radiating body and the stator is thus limited, and therefore also the heating of the stator.

The radiating body can be a heating rod protruding from the walls of the stator body, the vacuum pump comprising a plurality of discrete radiating bodies, at least six, evenly distributed in the periphery of the rotor or opposite the annular end of the rotor in the annular discharge.

The vacuum pump can be a primary vacuum pump, the stator comprising at least one pumping stage, the vacuum pump comprising two rotors configured to rotate synchronously in reverse directions in the at least one pumping stage.

Whether it be a turbomolecular vacuum pump or a primary vacuum pump, the radiating body can extend beyond the discharge orifice of the stator of the vacuum pump. Thus, the vacuum pump and the pipe situated at the discharge of the vacuum pump can be heated to the same temperature and with the same infrared radiation.

The at least one radiating body can be a thermal conductor in thermal contact with at least one heating cartridge of the vacuum pump, the heating cartridge being arranged outside of the pumping path of the gases. There are for example as many heating cartridges as there are heating fingers, for example two, each heating cartridge being in thermal contact with a heating finger. The ring transports and radiates the heat produced by the heating cartridges.

Cavities can be formed in the stator body around the heating cartridge. The transmission of heat from the heating cartridges to the rest of the stator is thus avoided.

The at least one radiating body can comprise a heating electrical resistor, the vacuum pump being able to further comprise an electrically and thermally insulating support interposed between the radiating body and the stator body.

The vacuum pump can comprise an external stator heating device, such as a heating resistive belt. The heating by the radiating body then complements the external stator heating device.

In the case where the processing unit of the heating device is configured for the radiating body to be powered by electrical current pulses, provision can be made to condition the intermittent heating of the radiating body in the absence of process gases to be pumped by the vacuum pump such that only inert gases, such as nitrogen, can be pumped by the vacuum pump when the radiating body radiates at very high temperature, this being done in order to avoid any chemical risk. The signal indicating absence of process gases can be supplied by the fabrication equipment in which the vacuum pump is mounted.

Another subject of the invention is a method for heating a heating device as described previously in which the radiating body is heated to a temperature greater than 150° C. to radiate in the infrared by being powered by electrical current pulses that make it possible to alternate periods of powering at a first power with periods of electrical powering at a second power lower than the first power or with periods of non-powering.

DESCRIPTION OF THE DRAWINGS

Other advantages and features will emerge on reading the following description of a particular but nonlimiting embodiment of the invention, and the attached drawings in which.

In these figures, the elements that are identical bear the same reference numbers.

The following embodiments are examples. Although the description refers to one or more embodiments, that does not necessarily mean that each reference relates to the same embodiment, or that the features apply only to a single embodiment. Simple features of different embodiments can also be combined or swapped to provide other embodiments.

"Upstream" is understood to mean an element which is placed before another with respect to the direction of circulation of the gas. On the other hand, "downstream" is understood to mean an element placed after another with respect to the direction of circulation of the gas to be pumped.

Figure 1:
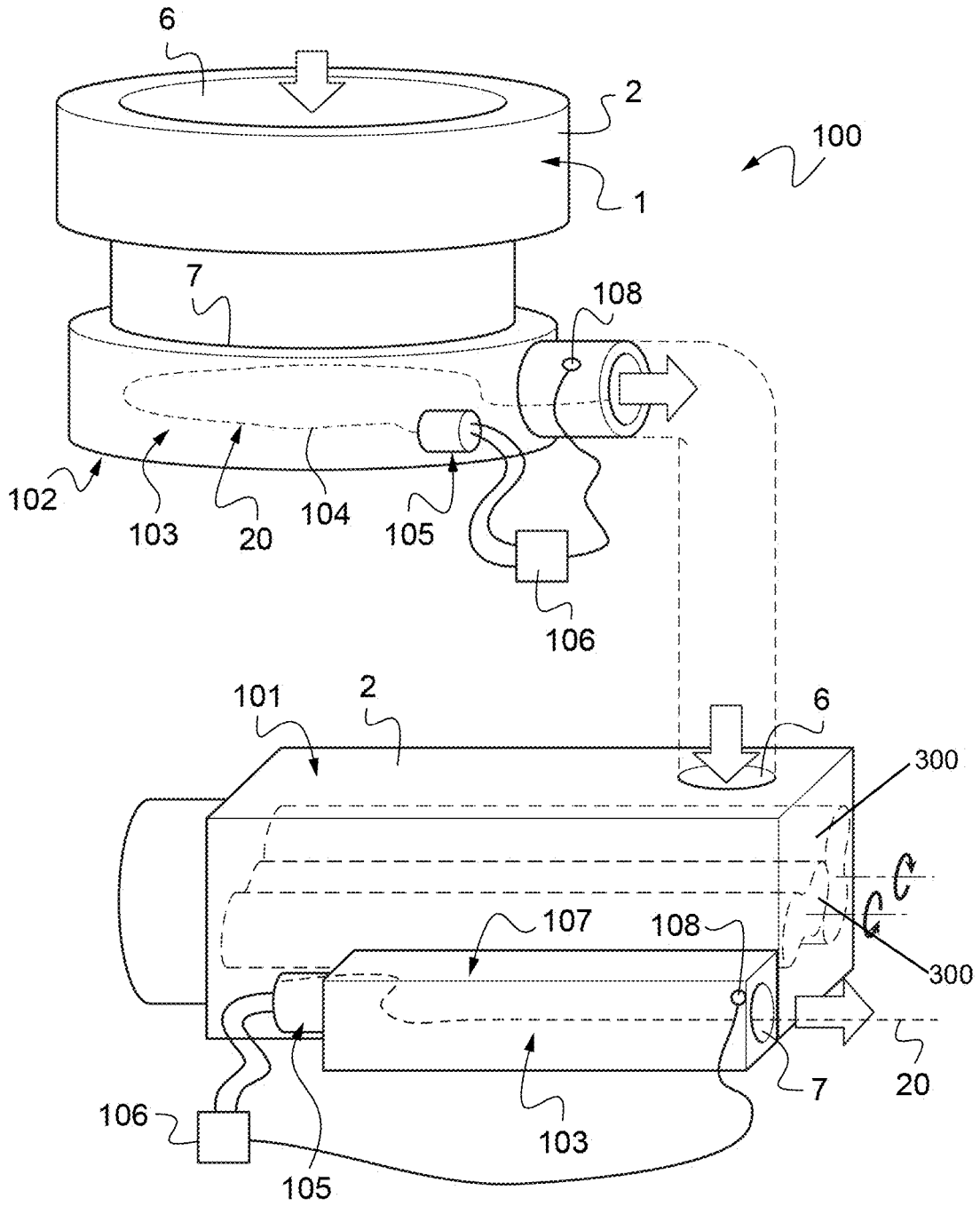
FIG. 1 shows an example of vacuum line.

FIG. 1 illustrates an example of a vacuum line 100 in which gases to be pumped are intended to circulate (the direction of circulation of the gases is represented by arrows in FIG. 1).

The vacuum line 100 comprises a turbomolecular vacuum pump 1, a primary vacuum pump 101 arranged downstream of the turbomolecular vacuum pump 1 and a pipe 102 (partly represented by dotted lines) connecting the turbomolecular vacuum pump 1 to the primary vacuum pump 101.

The vacuum line 100 is, for example, used for pumping chambers for equipment for the fabrication, for example, of flat display screens or photovoltaic substrates or semiconductor substrates (or wafers).

The primary vacuum pump 101 comprises a stator comprising at least one pumping stage and two rotors 300 configured to rotate synchronously in reverse directions in the at least one pumping stage.

The vacuum line 100 comprises at least one infrared radiation heating device 103 that can be arranged in the turbomolecular vacuum pump 1 or in the pipe 102 connected between the pumps 1, 101 or in the primary vacuum pump 101 as represented in FIG. 1, or even in a pipe connected to the output of the primary vacuum pump 101.

The heating device 103 comprises at least one radiating body 20 configured to radiate in the infrared when it is heated to a temperature greater than 150° C., the at least one radiating body 20 being arranged in the pumping path of the gases.

In the example of FIG. 1, a first heating device 103 comprises a radiating body 20 arranged in the pipe 102. The at least one radiating body 20 is fixed to the pipe 102 by being thermally insulated from the inner walls of the pipe 102.

A second heating device 103 is arranged in the primary vacuum pump 101, for example in the discharge 21 of the vacuum pump 101, such as in a silencer 107 of the vacuum pump 101.

The radiating body 20 preferably has a surface of emissivity greater than or equal to 0.4, such as greater than or equal to 0.8. The surface of high emissivity of the at least one radiating body 20 is, for example, obtained by surface treatment, such as by anodization or sand-blasting or grooving or texturing, for example by laser, or treated with soda or by deposition of a coating, such as a chemical coating deposited by plasma of KEPLA-COAT® type or such as a coating of solvent-free paint type, such as an epoxy polymer coating. The radiating body 20 of the surface of high emissivity can also be obtained by heat treatment, in particular of a radiating body made of steel or stainless steel, this heat treatment being able to create a change of colour of the material at a temperature greater than 500° C.

The inner walls of the pipe 102 and/or of the vacuum pump 1, 101 intended to be in communication with the pumped gases for example exhibit an emissivity less than or equal to 0.2. They are, for example, metallic, such as stainless steel.

The radiating body 20 comprises, for example, a bent rod 104 that is bent to follow the form of the pipe 102 or that of the silencer 107. The bent rod 104 for example comprises a heating electrical resistor that can be powered from outside the discharge pipe 102 via a tight passage 105.

In operation, the radiating body 20 radiates in the infrared inside the vacuum pump 1, 101 or the pipe 102 in the pumping path of the gases. The reflecting inner surfaces of the path of the pumped gases reflect the radiated heat in the absence of deposit while the deposits, generally of organic material and of stronger emissivity, greater than 0.5, absorb the heat. The deposits therefore absorb more heat and their temperature rises more than the walls. The heat reflected by the walls also returns to the radiating body or to the deposits. The deposits heated to high temperature can then be evaporated and driven in gaseous form to the discharge without overheating the walls. As soon as the thickness of the deposit is sufficiently small so as to no longer absorb the infrareds, the latter are reflected. The elimination of the deposits can therefore be performed automatically, without driving or cycling the heating which can remain at high temperature. The heating is also targeted and therefore efficient.

The radiating body 20 can extend beyond the discharge orifice 7 of the stator 2 of the vacuum pump 101 (FIG. 1). Thus, the vacuum pump 101 and the pipe situated at the discharge of the vacuum pump 101 can be heated to the same temperature and with the same infrared radiation.

The heating device 103 can comprise a processing unit 106 configured to control the heating of the radiating body 20.

The radiating body 20 can comprise a temperature probe 108, for example received in the sheath of the radiating body 20 when the latter comprises an electrical resistor received in a sheath. According to another example, the temperature probe 108 can be situated on the stator 2 of the vacuum pump 1, 101 or on the pipe 102 linking the pumps 1, 101, for example on the outside of the pipe 102.

In use, the radiating body 20 radiating in the infrared can be heated continuously to a temperature greater than 150° C.

According to another exemplary embodiment, the processing unit 106 can be configured to heat the radiating body 20 to a temperature greater than 150° C. for it to radiate in the infrared by being powered by pulses of electric current that make it possible to alternate periods of powering at a first power with periods of electrical powering at a second power lower than the first power or with periods of non-powering.

The duration of the pulses is, for example, greater than one minute and less than ten minutes. The temperature of the radiating body 20 can thus be increased intermittently to a temperature greater than 300° C., such as between 400° C. and 600° C.

The powering by electrical current pulses, that is to say discontinuously, makes it possible to optimize the rise in temperature of the radiating body before the thermal energy is diffused. The deposits can then be more easily heated to temperatures greater than the evaporation temperature of the deposits, notably of the deposits of PTFE type.

The processing unit 106 can be configured to monitor the presence of deposits based on the temperature of the radiating body 20 and on the thermal power radiated by the radiating body 20, for example by measuring the temperature of the radiating body 20 while the thermal power radiated by the radiating body 20 is controlled at a given setpoint or by measuring the thermal power radiated by the radiating body 20 while the temperature of the radiating body 20 is controlled at a given setpoint.

In fact, reaction by-products, notably deriving from certain semiconductor fabrication methods, are not only more emissive than the metals, but are also more thermally insulating. The thicker the layer of deposit becomes, the more it thermally insulates the stator body of the vacuum pump 1, 101 or the pipe 102 from the infrared heating. When the radiating body 20 is surrounded by surfaces of very low emissivity, it cannot transmit much energy to the body of the pump or of the pipe. This phenomenon is therefore used here to not only evaporate the deposits but also determine their presence, even their thickness.

According to another example, the processing unit 106 is configured to monitor the presence of deposits based on the measurement of the temperature of the surface of the pipe 102 of the vacuum line 100 and of the thermal power radiated by the radiating body 20, for example by measuring the temperature of the surface of the pipe 102 while the thermal power radiated by the radiating body 20 is controlled at a given setpoint.

A more detailed example is given with reference to FIGS. 2 to 9 illustrating a heating device 103 arranged in the turbomolecular vacuum pump 1.

Figure 2:
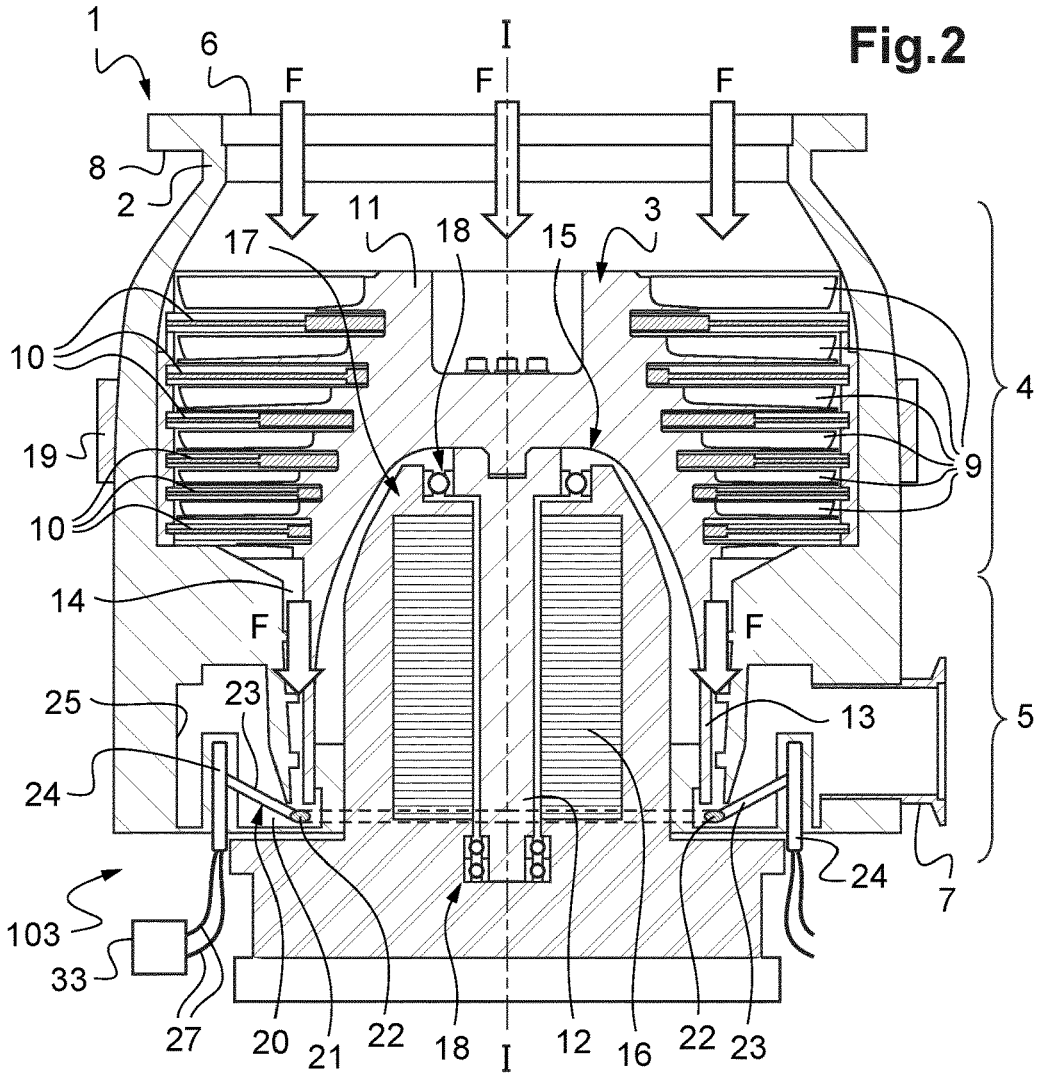
FIG. 2 shows an axial cross-sectional view of a turbomolecular vacuum pump according to a first embodiment.

As can be seen in FIG. 2, the turbomolecular vacuum pump 1 comprises a stator 2 in which a rotor 3 is configured to rotate at high speed with axial rotation, for example a rotation at more than ninety thousand revolutions per minute.

In the exemplary embodiment of FIG. 2, the turbomolecular vacuum pump 1 is said to be hybrid: it comprises a turbomolecular stage 4 and a molecular stage 5 situated downstream of the turbomolecular stage 4 in the direction of circulation of the pumped gases (represented by the arrow F in FIG. 2). The pumped gases enter through the suction orifice 6, pass first of all through the turbomolecular stage 4, and then through the molecular stage 5, to be then evacuated to a discharge orifice 7 of the turbomolecular vacuum pump 1. In operation, gases to be pumped are driven in the direction of circulation of the gases F going from a suction orifice 6 to a discharge orifice 7, the discharge orifice 7 being connected to a primary pumping system.

An input annular flange 8 surrounds, for example, the suction orifice 6 in order to connect the vacuum pump 1 to a chamber for which the pressure is wanted to be lowered.

In the turbomolecular stage 4, the rotor 3 comprises at least two stages of blades 9 and the stator 2 comprises at least one stage of fins 10. The stages of blades 9 and of fins 10 follow one another axially along the axis of rotation I-I of the rotor 3 in the turbomolecular stage 4. The rotor 3 comprises, for example, more than four stages of blades 9, such as, for example, between four and twelve stages of blades 9 (seven in the example illustrated in FIG. 2).

Each stage of blades 9 of the rotor 3 comprises inclined blades which start in a direction substantially radial from a hub 11 of the rotor 3 fixed to a drive shaft 12 of the vacuum pump 1, for example by screwing. The blades are evenly distributed on the periphery of the hub 11.

Each stage of fins 10 of the stator 2 comprises a crown ring from which start, in a substantially radial direction, inclined fins, evenly distributed over the inner perimeter of the crown ring. The fins of a stage of fins 10 of the stator 2 engage between the blades of two successive stages of blades 9 of the rotor 3. The blades 9 of the rotor 3 and the fins 10 of the stator 2 are inclined to guide the pumped gas molecules to the molecular stage 5.

In the example illustrated in the figures, the rotor 3 further comprises an internal bowl 15, coaxial to the axis of rotation I-I and arranged opposite a shroud 17 of the stator 2. In operation, the rotor 3 rotates in the stator 2 without contact between the internal bowl 15 and the shroud 17.

Here, in the molecular stage 5, the rotor 3 further comprises a Holweck skirt 13 downstream of the at least two stages of blades 9, formed by a smooth cylinder, which rotates opposite helical grooves 14 of the stator 2. The helical grooves 14 of the stator 2 make it possible to compress and guide the pumped gases to the discharge orifice 7.

The rotor 3 can be produced in a single piece. It is, for example, made of aluminium material and/or of nickel.

The rotor 3 is configured to be driven in rotation in the stator 2 by an internal motor 16 of the vacuum pump 1. The motor 16 is, for example, arranged in the shroud 17 of the stator 2, which is itself arranged in the internal bowl 15 of the rotor 3, the drive shaft 12 passing through the shroud 17 of the stator 2.

The rotor 3 is guided laterally and axially by magnetic or mechanical bearings 18 supporting the drive shaft 12 of the rotor 3, situated in the stator 2.

The shroud 17 can be configured to be able to be cooled in order to be able to continually cool the elements that it contains such as, notably, the bearings 18, the motor 16 and other electrical or electronic components, in order to allow them to operate.

The vacuum pump 1 can further comprise a purge device configured to inject a purge gas into the interstice situated between the shroud 17 of the stator 2 and the internal bowl 15 of the rotor 3. The purge gas is preferentially air or nitrogen, but can also be another neutral gas such as helium or argon. The purge gas flow rate is low.

The vacuum pump 1 further comprises at least one heating device 103 having a radiating body 20 configured to radiate in the infrared when it is heated to a temperature greater than 150° C., such as greater than or equal to 200° C., such as, for example, 300° C., the at least one radiating body 20 being fixed to the body of the stator 2 and arranged in the pumping path of the gases, by being thermally insulated from the inner walls of the stator 2.

In operation, the radiating body 20 radiates in the infrared inside the vacuum pump 1 in the pumping path of the gases. The inner surfaces of the vacuum pump 1 in the path of the pumped gases are generally reflecting and reflect the heat radiated in the absence of deposit while the deposits, generally of organic material and of stronger emissivity, greater than 0.5, absorb the heat. The deposits therefore absorb more heat and their temperature rises more than the walls of the vacuum pump 1. The heat reflected by the inner walls of the vacuum pump 1 also returns to the radiating body 20 or to the deposits. The deposits heated to high temperature can then be evaporated and driven in gaseous form to the outlet orifice 7 without overheating the rotor 3 or the inner walls of the stator 2. As soon as the thickness of the deposit is sufficiently small so as to no longer absorb the infrareds, the latter are reflected by the walls of the vacuum pump 1. The elimination of the deposits can therefore be performed automatically, without driving or cycling the heating which can remain at high temperature. The heating is also targeted and therefore efficient, without being damaging to the integrity of the rotor 3.

The inner walls of the stator 2 and the walls of the rotor 3 intended to be in communication with the pumped gases for example exhibit an emissivity less than or equal to 0.2, called low emissivity. The inner walls of the stator 2 and the walls of the rotor 3 intended to be in communication with the pumped gases of low emissivity are, for example, metallic, made of aluminium material or stainless steel or have a coating of low emissivity, comprising nickel for example. The walls can be polished.

These surfaces of low emissivity have the advantage of reflecting the infrared thermal radiations, which makes it possible, on the one hand, to avoid heating the inner walls of the stator 2 and the walls of the rotor 3 intended to be in communication with the pumped gases, and, on the other hand, to concentrate the heat on the deposits which, generally, are organic deposits exhibiting an emissivity greater than that of the surfaces of low emissivity. The fact that the walls of low emissivity of the stator 2 and of the rotor 3 in communication with the pumped gases, made of aluminium, stainless steel or steel or coated aluminium, are produced in materials of low emissivity is thereby used to notably make it possible to withstand corrosion. These properties of low emissivity contribute to avoiding the heating of the vacuum pump 1 while promoting the heating of the undesirable deposits.

The at least one radiating body 20 is advantageously situated in the annular discharge 21 of the vacuum pump 1, downstream of the rotor 3 and upstream of the discharge orifice 7 in the direction of circulation of the gases. The annular discharge 21 is situated under the rotor 3, here under the end of the Holweck skirt 13. This is a location where the pressure is higher and therefore where the risk of deposit is greater.

The radiating body 20 comprises, for example, a ring 22 arranged at the periphery of the rotor 3, for example between the turbomolecular stage 4 and the molecular stage 5, or opposite the annular end of the rotor 3, in the annular discharge 21 of the vacuum pump 1.

The radiating body 20 further comprises at least one heating finger 23 linking the ring 22 to the stator body 2.

The ring 22 is the element of the radiating body 20 that has a surface of strong emissivity radiating in the infrared. The annular form of the radiating body 20 makes it possible to increase the radiation surface.

The ring 22 can have a spherical or ovoid section or the ring 22 can have a disc surface. The disc makes it possible to increase the radiation surface. The diameter of the ring 22 of spherical section is, for example, 1 cm. A thin ring allows for a faster temperature rise.

The radiating body 20 comprises, for example, a single heating finger 23 or two heating fingers 23 diametrically opposite, or several heating fingers 23 on the periphery of the ring 22.

Figure 3:
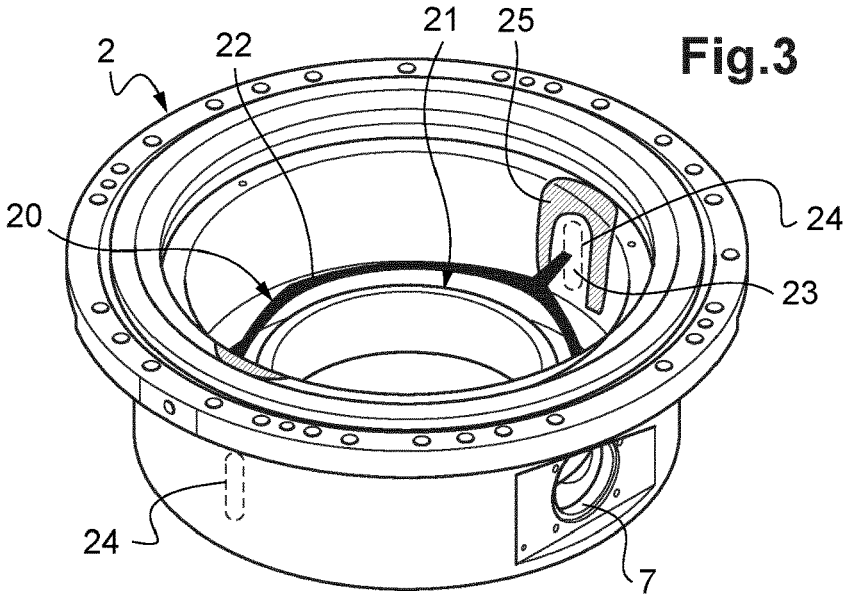
FIG. 3 shows a perspective view of a part of the stator and a radiating body arranged in the annular discharge of the turbomolecular vacuum pump of FIG. 2.

The at least one heating finger 23 can further form a spacer holding the ring 22 away from the stator body 2. The thermal contact between the radiating body 20 and the stator 2 is thus limited, and therefore also the heating of the stator 2. As can be seen better in the example of FIG. 3 showing only a part of the stator 2, and the radiating body 20, the ring 22 is a way "suspended" by two heating fingers 23, above the wall of the stator 2 in the annular discharge 21.

In this example, the radiating body 20 is heated indirectly. The radiating body 20 is, for example, a thermal conductor, for example made of metallic material, such as of aluminium, and in thermal contact with at least one heating cartridge 24 of the vacuum pump 1.

There are for example as many heating cartridges 24 as there are heating fingers 23, for example two, each heating cartridge 24 being in thermal contact with a heating finger 23. In the embodiment of the ring 22 linked to the stator body 2 by two heating fingers 23, the vacuum pump 1 thus comprises two heating cartridges 24 in thermal contact with a respective heating finger 23. The ring 22 thus transfers and radiates the heat produced by the heating cartridges 24.

The heating cartridges 24 are arranged outside of the pumping path of the gases, in the stator 2. There is then no need to produce the seal around these heating cartridges 24 which are not in a vacuum. These heating cartridges 24 are for example heated between 20 and 50° C. above the desired temperature for the radiating body 20. The cavities 25 can be formed in the stator body 2 around the heating cartridges 24. The transmission of heat from the heating cartridges 24 to the rest of the stator 2 is thus avoided.

The turbomolecular vacuum pump 1 can comprise an external heating device 19 of the stator 2, such as a heating resistive belt, for heating the stator 2 to a setpoint temperature, for example greater than 80° C., such as 100° C. The heating by the radiating body 20 then complements the external heating device 19 of the stator 2.

The heating device 103 can comprise a processing unit 33 configured to control the heating of the radiating body 20. The processing unit 33 comprises, for example, a controller, a microcontroller or a microprocessor. The processing unit 33 can be mounted on an electronic circuit board housed in the stator 2 of the vacuum pump 1.

In use, the radiating body 20 radiating in the infrared can be heated continuously to a temperature greater than 150° C.

According to another example, the processing unit 33 is configured to heat the radiating body 20 to a temperature greater than 150° C. for it to radiate in the infrared by being powered by pulses of electrical current making it possible to alternate periods of powering at a first power with periods of electrical powering at a second power lower than the first power or with periods of non-powering.

The duration of the pulses is for example greater than one minute and less than ten minutes. The temperature of the radiating body 20 can be increased intermittently to a temperature greater than 300° C., such as between 400° C. and 600° C.

The powering by pulses of electrical current, that is to say discontinuously, makes it possible to optimize the rise in temperature of the radiating body 20 before the thermal energy is diffused in the body of the vacuum pump 1. The deposits can then be more easily heated to temperatures greater than the evaporation temperature of the deposits, notably of the deposits of PTFE type.

Provision can be made to condition the intermittent heating of the radiating body 20 to the absence of process gases to be pumped by the vacuum pump 1 such that only inert gases, such as nitrogen, can be pumped by the vacuum pump 1 when the radiating body 20 radiates at very high temperature, and to do so to avoid any chemical risk. The signal indicating absence of process gases can be supplied by the manufacturing equipment in which the vacuum pump 1 is mounted.

Moreover, the processing unit 33 can be configured to monitor the presence of deposits based on the temperature of the radiating body 20 and on the thermal power radiated by the radiating body 20, for example by measuring the temperature of the radiating body 20 while the thermal power radiated by the radiating body 20 is controlled at a given setpoint or by measuring the thermal power radiated by the radiating body 20 while the temperature of the radiating body 20 is controlled at a given setpoint.

In fact, the reaction by-products, notably deriving from certain semiconductor fabrication methods, are not only more emissive than the metals of the vacuum pump 1, but are also more thermally insulating. The thicker the layer of deposit becomes, the more it thermally insulates the stator body 2 of the vacuum pump 1 from the infrared heating. When the radiating body 20 is surrounded by surfaces of very low emissivity, it cannot transmit much energy to the vacuum pump 1. This phenomenon is therefore used here to not only evaporate the deposits, but to also determine their presence, even their thickness.

Figure 4:
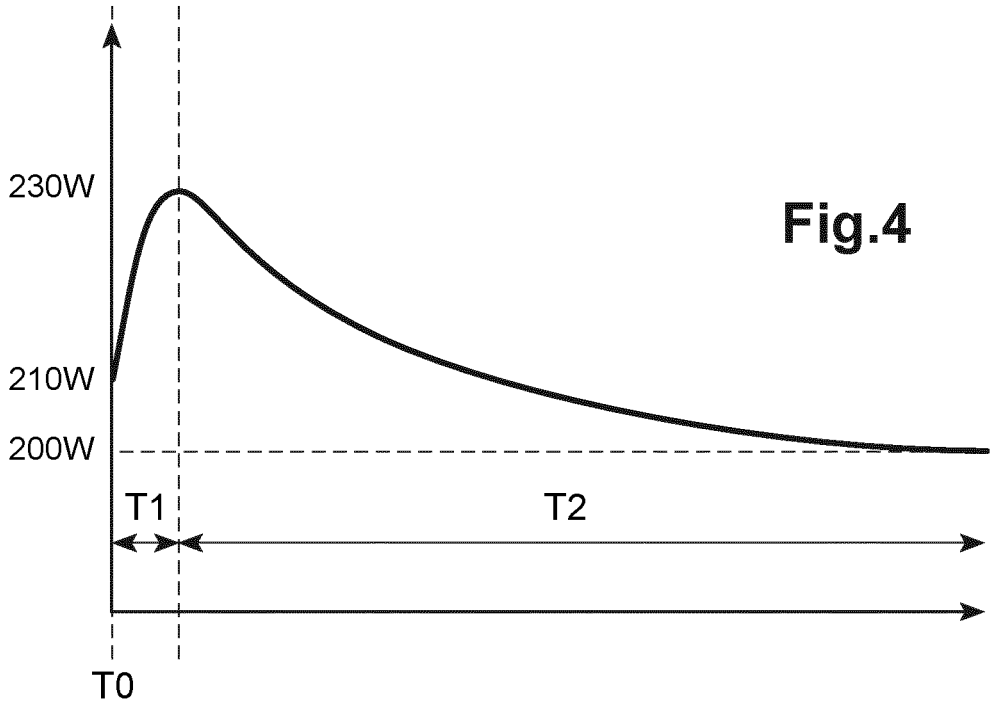
FIG. 4 is a curve of the trend of the power (in watts) powering the radiating body as a function of the thickness of the layer of deposit for a given temperature of the radiating body.

This can be better understood with reference to the curve of FIG. 4 showing an example of the trend of the power for a given temperature of the radiating body 20 and a given temperature of the stator 2, as a function of the thickness of the layer of deposit.

In the absence of deposit, the inner walls of the stator 2 and the walls of the rotor 3 in communication with the pumped gases exhibit low emissivity such that the infrared radiation is mostly reflected by these surfaces. The thermal power transmitted, for a given temperature of the radiating body 20, is low (TO in the curve of FIG. 4).

In the presence of a light deposit, the layer of deposit renders the inner walls of the stator 2 and the walls of the rotor 3 in communication with the pumped gases emissive to the infrareds, the power transmitted, for a given temperature of the radiation body 20, increases then because the heat serves to heat all of the walls of the vacuum pump 1. It is then possible to detect the presence, even determine the thickness, of a layer of deposit by detection of this increase of power (phase T1 in the curve of FIG. 4).

Then, the more the thickness of the deposit increases, the more the inner walls of the stator 2 and the walls of the rotor 3 in communication with the pumped gases thermally insulate. The power, for a given temperature of the radiating body 20, then decreases. It is then also possible to detect the presence of a layer of deposit, even determine the thickness of the layer of deposit, by detection of this decrease in power (phase T2 in the curve of FIG. 4).

The presence of the phase T1 or T2 of the curve can be distinguished to determine the thickness of the deposit, for example by analysis of the slope of the curve, the slope of the phase T1 being positive and the slope of the phase T2 being negative.

Figure 5:
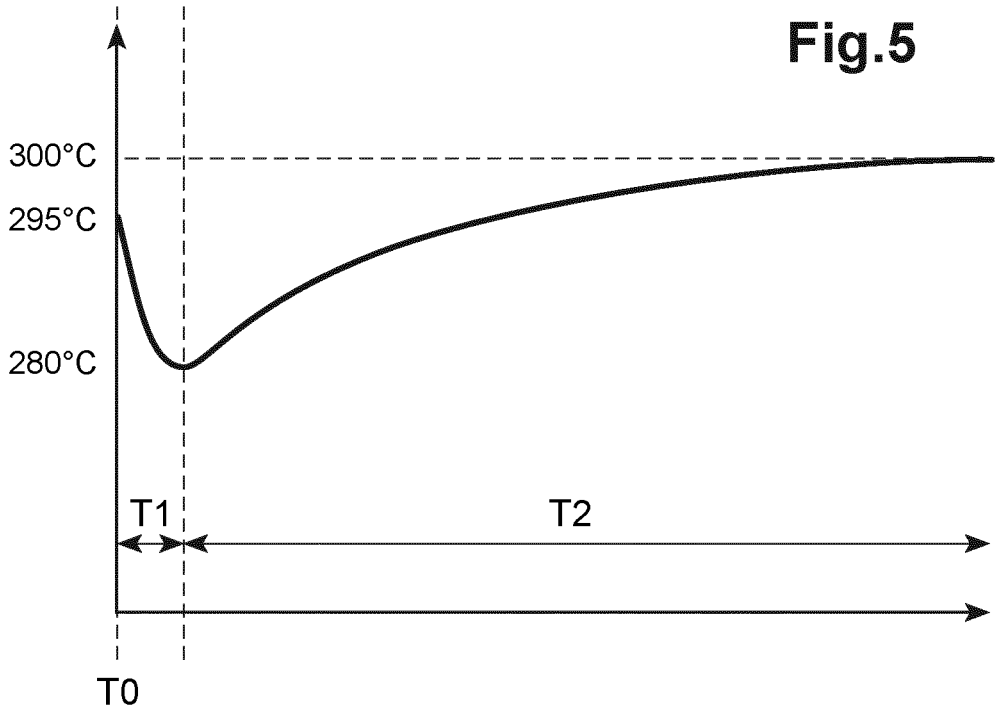
FIG. 5 is a curve of the trend of the temperature (in ° C.) of powering of the radiating body as a function of the thickness of the layer of deposit for a given powering power of the radiating body.

FIG. 5 illustrates a variant embodiment for which it is the thermal power which is kept constant while the temperature of the radiating body 20 is measured.

As previously, in the absence of deposit, the inner walls of the stator 2 and the walls of the rotor 3 in communication with the pumped gases exhibit little emissivity such that the infrared radiation is mostly reflected by the surfaces. The temperature of the radiating body 20, for a given thermal power, is low (TO in the curve of FIG. 5).

In the presence of a light deposit, the temperature of the radiating body 20 lowers for a given power, because the heat serves to heat all the walls of the vacuum pump 1. It is therefore possible to detect the presence, even determine the thickness, of a layer of deposit, by detection of this decrease in temperature (phase T1 in the curve of FIG. 5).

Then, the more the thickness of the deposit increases, the more the inner walls of the stator 2 and the walls of the rotor 3 in communication with the pumped gases thermally insulate. The temperature of the radiating body 20, for a given power, then increases. It is therefore also possible to detect the presence of a layer of deposit, even determine the thickness of the layer of deposit, by detection of this increase in temperature (phase T2 of the curve of FIG. 5).

As previously, the presence of the phase T1 or T2 of the curve can be distinguished to determine the thickness of the deposit, for example by analysis of the slope of the curve, the slope of the phase T1 being negative and the slope of the phase T2 being positive.

Figure 6:
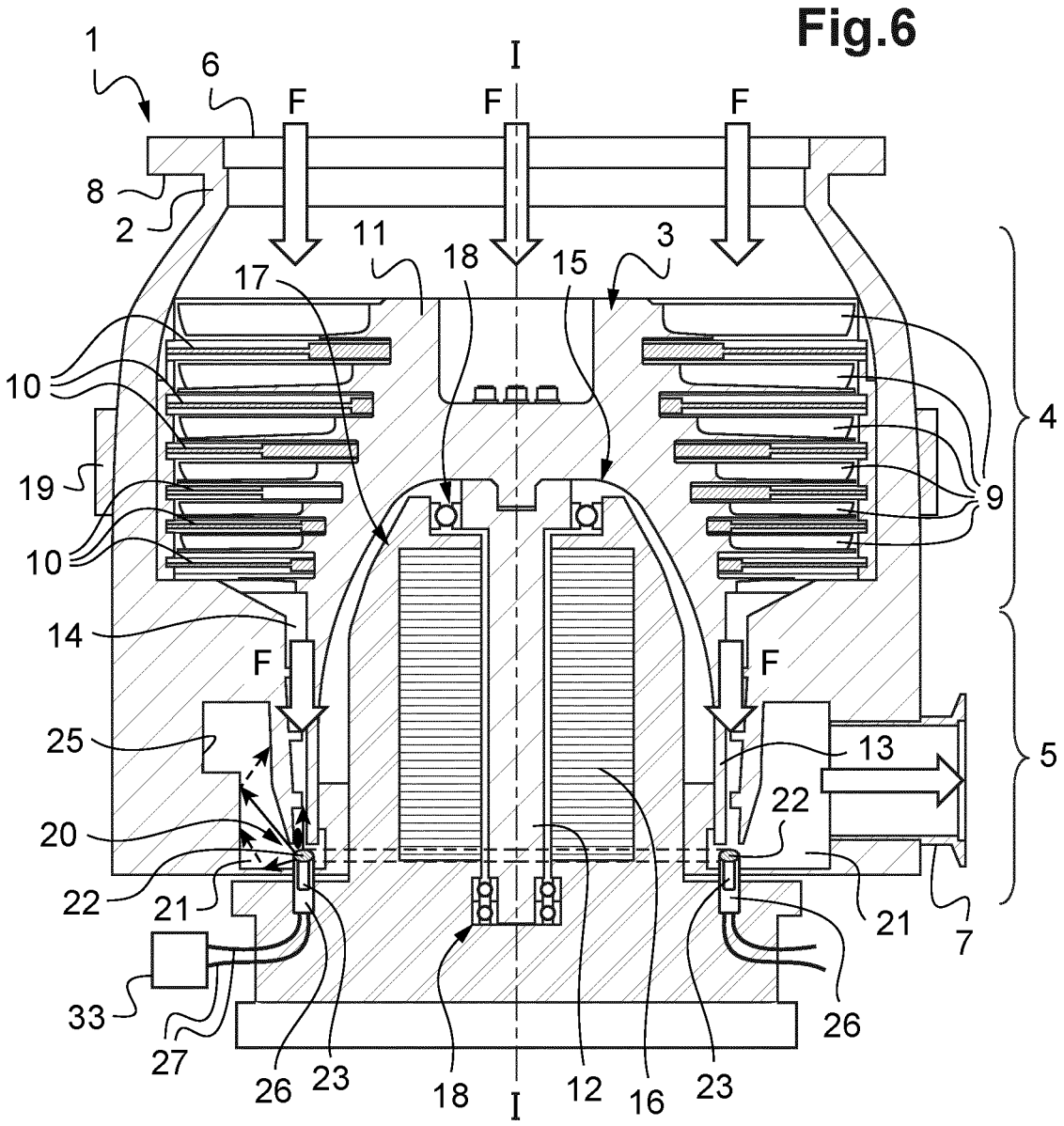
FIG. 6 shows an axial cross-sectional view of another exemplary embodiment of a turbomolecular vacuum pump.

FIG. 6 shows a second exemplary embodiment.

As in the preceding example, the at least one radiating body 20 can be situated in the annular discharge 21 of the vacuum pump 1 and comprise a ring 22 held away from the stator body 2 by two heating fingers 23 of the radiating body 20.

However, in this second example, the radiating body 20 is heated directly.

For that, the radiating body 20 comprises a heating electrical resistor, that can be powered electrically to heat up. The electrical resistor is for example received in a sheath, for example of stainless steel. The electrical resistor and its sheath are bent to form the ring 22 of the radiating body 20. The at least one heating finger 23 is linked to the stator 2 by means of a tight entry for the passage of electrical power supply wires for the electrical resistor. A tight entry for electrical wires is known per se and makes it possible to guarantee the seal between the inside and the outside of the vacuum pump 1.

The vacuum pump 1 can further comprise an electrically and thermally insulating support 26 interposed between the radiating body 20 and the stator body 2. More specifically in this example, the insulating support 26 is interposed between the ring 22 of the radiating body 20 and the stator body 2, and surrounds the heating fingers 23. The insulating support 26 is for example made of stainless steel. This is a weakly thermally insulating material but one that is compatible with the vacuum levels sought and chemistry of the pumped gases.

This embodiment by direct heating makes it possible to rapidly heat the radiating body 20 and is particularly well suited for the implementation of a heating method based on electrical current pulses.

It can be seen in FIG. 6 that the radiating body 20 is connected by electrical wires 27 for the power supply to the processing unit 33. Also represented in this figure are the infrared thermal rays which are reflected by the inner walls of the stator 2, often several times over, and which are absorbed by the deposit.

Although the radiating bodies 20 illustrated in these figures comprise rings, other embodiments are possible for the radiating bodies.

Figure 7:
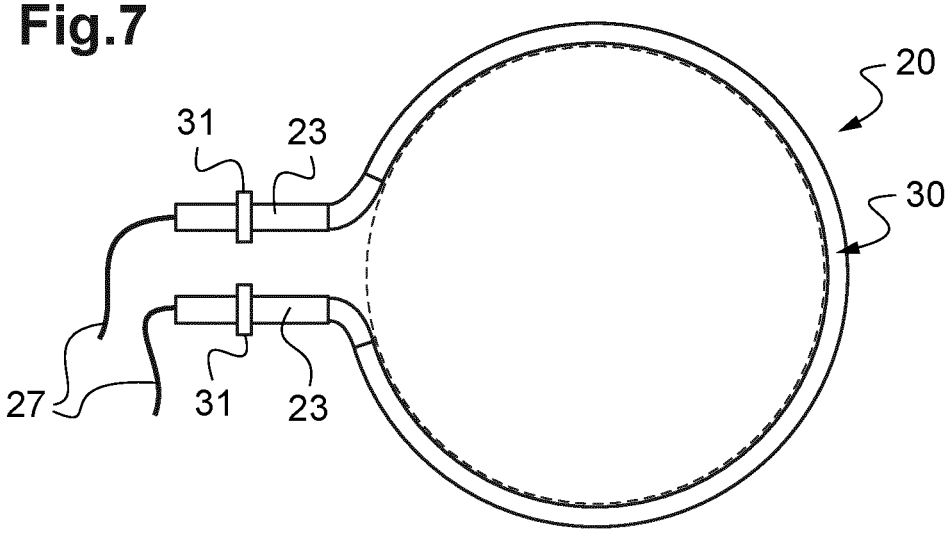
FIG. 7 shows a perspective view of another exemplary embodiment of a radiating body.
Figure 8:
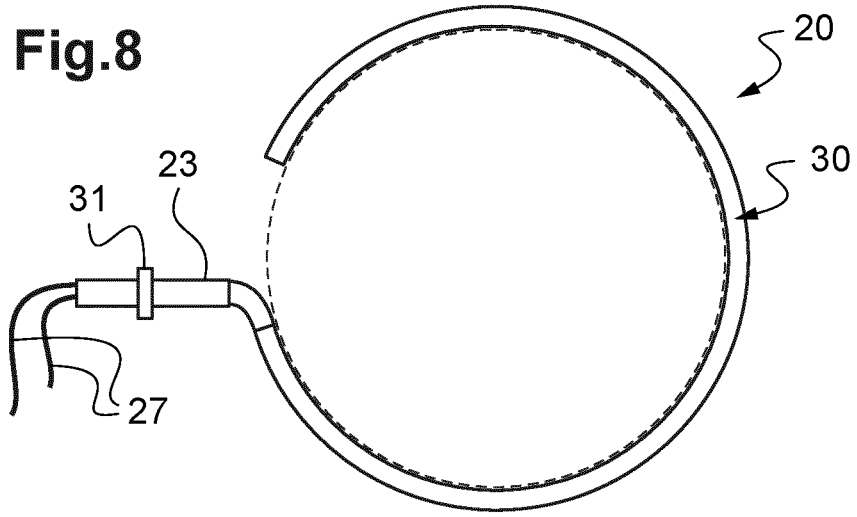
FIG. 8 shows a perspective view of another exemplary embodiment of a radiating body.

According to another example represented in FIGS. 7 and 8, the radiating body 20 comprises a portion of ring 30 arranged at the periphery of the rotor 3 or opposite the annular end of the rotor 3 in an annular discharge 21 of the vacuum pump 1, and at least one heating finger 23 linking the portion of ring 30 to the stator body 2.

The portion of ring 30 is the element of the radiating body 20 having a surface of strong emissivity radiating in the infrared.

The portion of ring 30 has a circumference less than that of a ring, such as, for example, between 80% and 90% of the circumference of the circle in which the portion of ring 30 fits.

As for the ring 22 described in the preceding exemplary embodiments, the portion of ring 30 can have a spherical or ovoid section or be flat.

The radiating body 20 comprises, for example, a single heating finger 23 arranged at one end of the portion of ring 30 (FIG. 8) or two heating fingers 23 arranged at each end of the portion of ring 30 (FIG. 7).

The heating finger 23 can further form a spacer holding the portion of ring 30 away from the stator body 2 above the wall of the stator 2 in the annular discharge 21 for example.

The radiating body 20 can be a thermal conductor heated indirectly via at least one heating cartridge or it can comprise an electrical resistor heated directly by an electrical power supply.

In direct heating, the heating fingers 23 are, for example, linked to the stator 2 by means of a respective tight entry 31 for the electrical power supply wires 27. There are for example two electrical power supply wires 27 passing through the same tight entry 31 of the single heating finger 23 to power the heating resistor arranged in the portion of ring 30 of the radiating body 20 (FIG. 8) or a single electrical power supply wire 27 running along the electrical resistor along the portion of ring 30 passing through a tight entry 31 at each end of the portion of ring 30 (FIG. 7).

Figure 9:
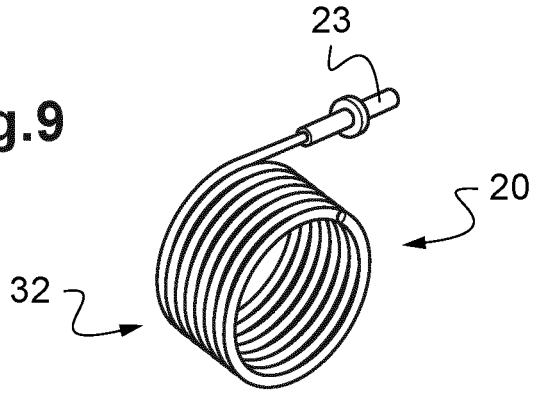
FIG. 9 shows a perspective view of another exemplary embodiment of a radiating body.

According to another example represented in FIG. 9, the radiating body 20 comprises a coil 32 forming more than one turn around the rotor 3, for example in the helical grooves 14 of the stator 2 or forming more than one turn opposite the annular end of the rotor 3 in an annular discharge 21 of the vacuum pump 1, more than seven turns in the example of FIG. 9, and at least one heating finger 23 linking the coil 32 to the stator body 2. The coil thus encircles the shroud 17 of the stator 2 several times under the rotor 3.

According to another example, the radiating body 20 is a heating rod protruding from the walls of the stator body 2, the vacuum pump 1 comprising a plurality of discrete radiating bodies, at least six, evenly distributed in the periphery of the rotor 3 or opposite the annular end of the rotor 3 in the annular discharge 21.

According to another example, the radiating body 20 arranged in the turbomolecular vacuum pump 1 more generally comprises, as in the example of FIG. 1, a bent rod.

The radiating body 20, particularly if it takes the form of a bent rod or a coil, can extend beyond the discharge orifice 7 of the stator 2 of the vacuum pump 1. Thus, the vacuum pump 1 and the pipe 102 situated at the discharge of the vacuum pump 1 can be heated to the same temperature and with the same infrared radiation.

The invention claimed is:

1. A vacuum pump configured to drive gases to be pumped in a direction of circulation of the gases going from a suction orifice to a discharge orifice, the vacuum pump comprising:

a stator and at least one rotor configured to rotate in the stator; and a heating device comprising at least one radiating body configured to radiate in the infrared when the at least one radiating body is heated to a temperature above 150° C., the at least one radiating body being arranged in the pumping path of the gases by being fixed to a body of the stator and by being thermally insulated from inner walls of the stator, the inner walls of the stator and walls of the at least one rotor configured to be in communication with the pumped gases exhibiting an emissivity less than or equal to 0.2, the at least one radiating body having a surface of emissivity greater than or equal 0.4.

2. The vacuum pump according to claim 1, wherein the surface of emissivity of the at least one radiating body is obtained:

by surface treatment, by deposition of a coating, or by heat treatment.

3. The vacuum pump according to claim 1, wherein the surface of emissivity of the at least one radiating body is obtained:

by surface treatment, the surface treatment including treatment by anodization or sand-blasting or grooving or texturing or treatment with soda, by deposition of a coating, the deposition of the coating including a chemical coating deposited by plasma or a coating of solvent-free paint type, or by heat treatment.

4. The vacuum pump according to claim 1, wherein the heating device comprises at least one heating cartridge, the at least one radiating body being a thermal conductor in thermal contact with the at least one heating cartridge, the at least one heating cartridge being arranged out of the pumping path of the gases.

5. The vacuum pump according to claim 4, wherein cavities are formed in the body of the stator surrounding the at least one heating cartridge.

6. The vacuum pump according to claim 1, wherein the at least one radiating body comprises a heating electrical resistor.

7. The vacuum pump according to claim 1, wherein the heating device comprises a processing unit configured to control the heating of the at least one radiating body.

8. The vacuum pump according to claim 7, wherein the processing unit is configured to heat the at least one radiating body to a temperature above 150° C. for it to radiate in the infrared by being powered by electrical current pulses that make it possible to alternate periods of powering at a first power with periods of electrical powering at a second power lower than the first power or with periods of non-powering.

9. The vacuum pump according to claim 7, wherein the processing unit is configured to monitor the presence of deposition from the temperature of the at least one radiating body or from the measurement of the temperature of the surface of a pipe of a vacuum line and of a thermal power radiated by the at least one radiating body.

10. The vacuum pump according to claim 1, wherein the inner walls of the stator and the walls of the at least one rotor configured to be in communication with the pumped gases are made of aluminium material or stainless steel or have a coating comprising nickel.

11. The vacuum pump according to claim 1, wherein the at least one radiating body is situated at the discharge orifice of the vacuum pump.

12. The vacuum pump according to claim 1, wherein the vacuum pump is a turbomolecular vacuum pump, the stator comprising at least one stage of fins and the at least one rotor comprising at least two stages of blades, the at least two stages of blades and the at least one stage of fins following one another axially along an axis of rotation of the at least one rotor.

13. The vacuum pump according to claim 12, wherein the at least one radiating body comprises a ring or a portion of ring, arranged at a periphery of the at least one rotor or opposite an annular end of the at least one rotor in an annular discharge of the vacuum pump, and at least one heating finger linking the ring or the portion of ring to the stator body.

14. The vacuum pump according to claim 13, wherein the at least one heating finger forms a spacer holding the ring or the portion of ring away from the stator body.

15. The vacuum pump according to claim 12, wherein the at least one radiating body comprises a coil forming more than one turn around the at least one rotor or forming more than one turn in an annular discharge of the vacuum pump, and at least one heating finger linking the coil to the stator body.

16. The vacuum pump according to claim 15, wherein the at least one heating finger forms a spacer holding the coil away from the stator body.

17. The vacuum pump according to claim 1, wherein the at least one radiating body is a heating rod protruding from walls of the stator body, the vacuum pump comprising a plurality of radiating bodies evenly distributed at a periphery of the at least one rotor or opposite an annular end of the at least one rotor in an annular discharge.

18. The vacuum pump according to claim 1, wherein the vacuum pump is a primary vacuum pump, the stator comprising at least one pumping stage, wherein the at least one rotor comprises two rotors configured to rotate synchronously in reverse directions in the at least one pumping stage.

19. The vacuum pump according to claim 1, wherein the at least one radiating body extends beyond the discharge orifice of the vacuum pump.

* * * * *